US005142924A

United States Patent [19]

Fasola et al.

[11] Patent Number: 5,142,924

[45] Date of Patent: Sep. 1, 1992

[54] STARTER DEVICE FOR INTERNAL COMBUSTION ENGINES AND AN ELECTROMAGNETICALLY-OPERATED STARTER MOTOR PROVIDED WITH THE DEVICE

[75] Inventors: Giancarlo Fasola, Milan; Pietro Navarra, Cologno Monzese, both of Italy

[73] Assignee: Industrie Magneti Marelli SpA, Milano, Italy

[21] Appl. No.: 714,418

[22] Filed: Jun. 12, 1991

[30] Foreign Application Priority Data

Jun. 12, 1990 [IT] Italy ..... 67426 A/90

[51] Int. Cl.[5] ..... F02N 15/06; H01H 51/06

[52] U.S. Cl. ..... 74/7 A; 200/279; 335/131

[58] Field of Search ..... 74/6, 7 R, 7 A; 200/279; 335/126, 131

[56] References Cited

U.S. PATENT DOCUMENTS

| | | | |
|---|---|---|---|
| 2,791,659 | 5/1957 | Matthias | 335/131 |
| 4,450,423 | 5/1984 | Morishita | 335/131 |
| 4,579,010 | 4/1986 | Colvin et al. | 335/131 X |
| 4,801,909 | 1/1989 | Fasola | 335/176 X |

FOREIGN PATENT DOCUMENTS

| | | | |
|---|---|---|---|
| 1004704 | 3/1957 | Fed. Rep. of Germany | 335/131 |
| 879667 | 11/1981 | U.S.S.R. | 200/279 |
| 2018030 | 11/1979 | United Kingdom | 335/131 |

*Primary Examiner*—Allan D. Herrmann

*Attorney, Agent, or Firm*—Sughrue, Mion, Zinn, Macpeak & Seas

[57] ABSTRACT

An electromagnetically-operated starter motor has a movable electrical contact constituted by a metal plate having, in one of its flat faces, a notch adapted to define an apical region which is subject to stresses within its plastic range. A vibration damper is thus created within the movable contact and eliminates problems resulting from resilient impacts between the contacts.

5 Claims, 4 Drawing Sheets

STARTER DEVICE FOR INTERNAL COMBUSTION ENGINES AND AN ELECTROMAGNETICALLY-OPERATED STARTER MOTOR PROVIDED WITH THE DEVICE

BACKGROUND OF THE INVENTION

The present invention relates to a starter device for internal combustion engines, including a movable element slidable in a hollow support structure and carrying a movable electrical contact for cooperating with fixed contacts carried by the structure, during starting.

Starter devices of the aforesaid type are used in electromagnetically-operated electric starter motors, the movable element being constituted by the core of an electromagnet which operates the lever for engaging the starter motor, or by a rod located in front of the core of the electromagnet on the axis thereof and adapted to be operated by the core when it is near one of its end-of-travel positions.

In the first case (a movable electrical contact fixed to the core of the electromagnet) it is necessary to make the movable electrical contact perform the same operating stroke as the core of the electromagnet. This involves problems with the bulk of the electrical switch associated with the electromagnet for operating the starter motor.

In the second case (a movable rod separate from the core of the electromagnet for operating the electrical contact) a more compact switch can be provided since the core of the electromagnet comes into contact with an end of the rod only near the end of its travel in order to close the contact. Whilst it has been found to be very reliable and compact, this solution may involve the risk of undesirable "sticking" of the movable contact to the fixed contacts since it lacks the considerable pull of the electromagnet which is returned to its rest position after starting by means of a suitable spring. The separation of the contacts is therefore entrusted to a weak spring that urges the rod on which the movable electrical contact is mounted towards a rest position in which it is spaced from the fixed electrical contacts. The risk of "sticking" of the contacts results from the considerable acceleration stresses to which the electrical contacts are subjected when they are closed. These impact stresses cause the movable contact to "bounce" repeatedly on the fixed contacts, causing successive openings/closures of the electrical circuit and high voltage peaks resulting in electrical arcs which may lead to localised fusion of the metal and consequent welding of the contacts.

SUMMARY OF THE INVENTION

The object of the present invention is to provide a device of the type specified at the beginning of the description which does not have the aforesaid disadvantages and which is easy and cheap to produce.

According to the invention, this object is achieved by virtue of the fact that the movable electrical contact has at least one region which is subject to the effect of a plastically-deformable stress raiser for damping the impact between the movable contact and the fixed contacts.

Preferably, the region which is subject to the stress-raising effect is defined by a notch in one face of a metal plate constituting the movable contact.

By virtue of these characteristics, the apical region of the notch is subject to mechanical stresses greater than those which can be sustained by the material constituting the plate within its elastic range, whilst the rest of the material is subject to stresses which are within its elastic range. Instead of bouncing on the fixed electrical contacts after impact, the movable electric contact absorbs the kinetic energy of the impact internally by localised plastic deformation. The electrical switch is therefore not subject to the wide voltage and current fluctuations (with the formation of electrical arcs) typical of prior-art starter devices.

According to a further characteristic, a cup-shaped element carrying the fixed contacts is mounted on the hollow structure which supports the movable element, a damping element of elastomeric material being interposed between the structure and the cup-shaped element.

The presence of the damping element, which is preferably annular, further reduces the acceleration stresses on the fixed electrical contacts and helps to eliminate completely any risk of sticking of the contacts.

BRIEF DESCRIPTION OF THE DRAWINGS

Further advantages and characteristics of the starter device according to the invention will become clear from the detailed description which follows, provided purely by way of non-limiting example with reference to the appended drawings, in which.

DETAILED DESCRIPTION OF THE INVENTION

Figure 1:
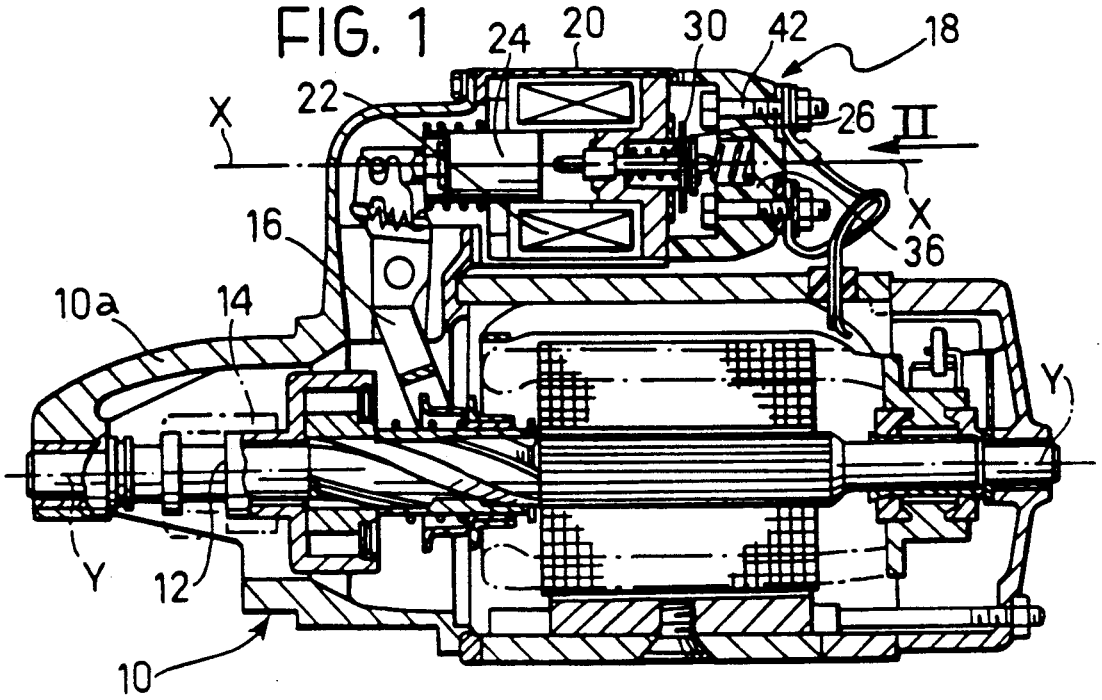
FIG. 1 is a longitudinal sectional view of an electromagnetically-operated starter motor according to the invention.
Figure 2:
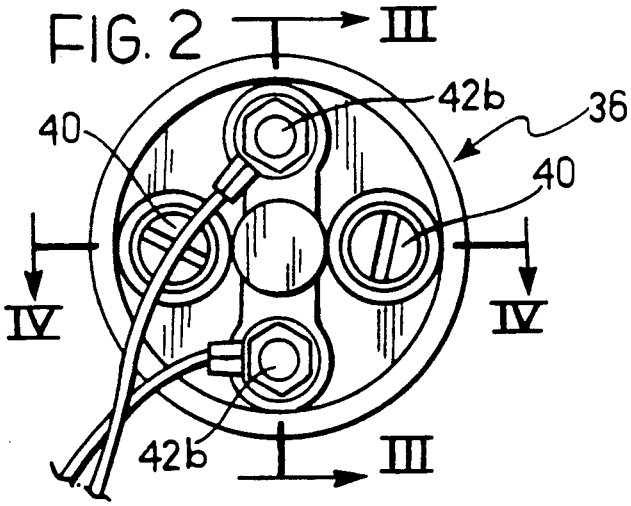
FIG. 2 is a view taken on the arrow II of FIG. 1.
Figure 5:
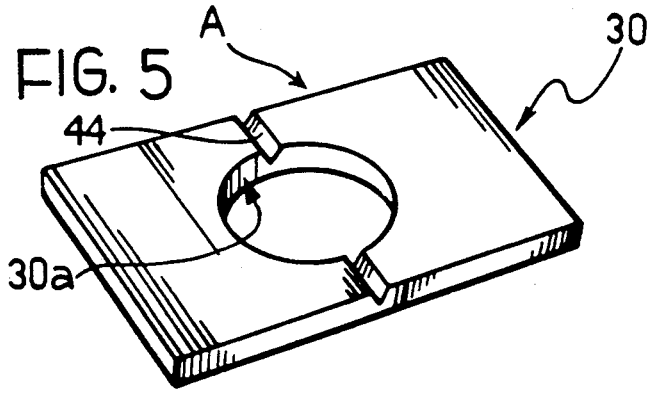
FIG. 5 is a perspective view of a detail of FIG. 3.
Figure 3:
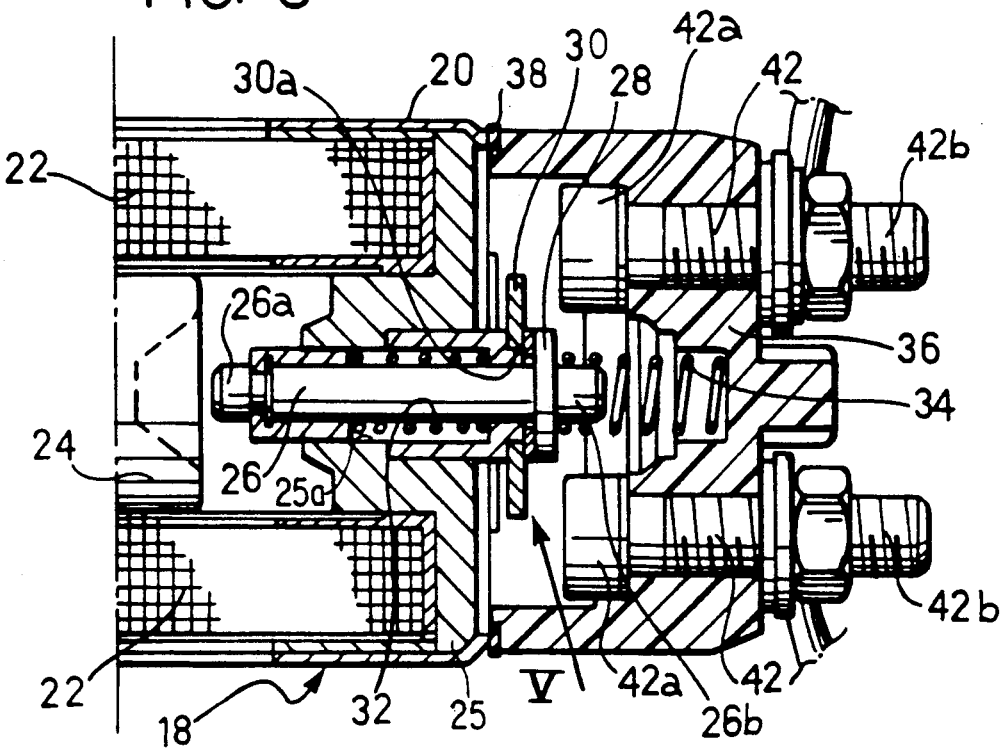
FIG. 3 is a section taken on the line III—III of FIG. 2.
Figure 4:
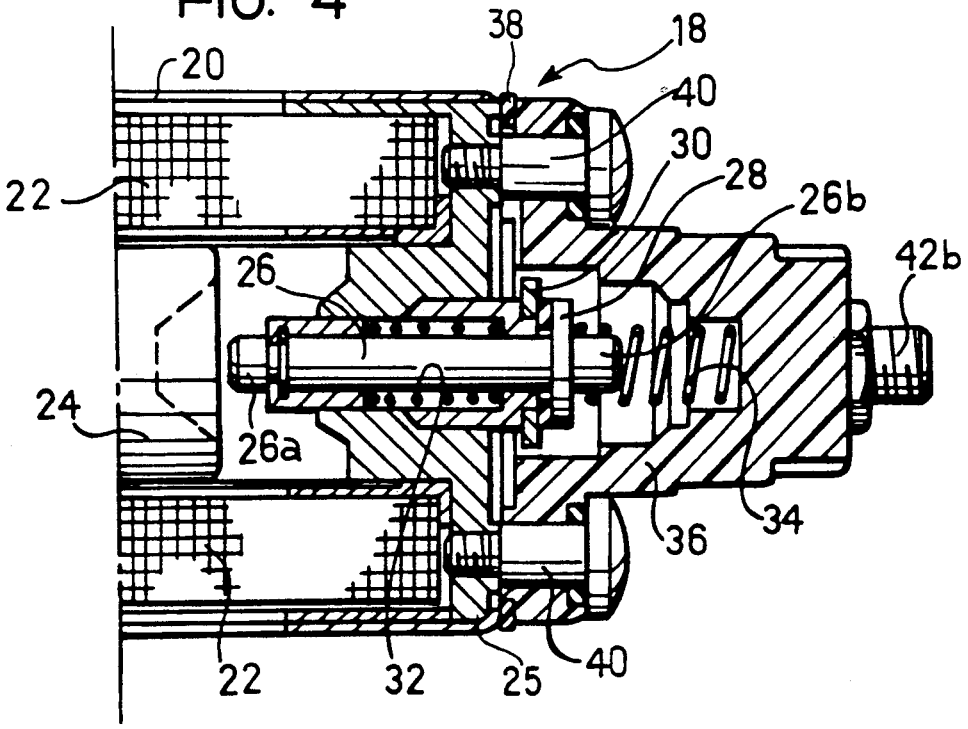
FIG. 4 is a section taken on the line IV—IV of FIG. 2.

With reference to the drawings, an electromagnetically-operated, electric starter motor, generally indicated 10, includes a hollow support structure 10*a* in which a shaft 12 for operating an engagement pinion 14 is rotatable. The pinion 14 is slidable on the shaft 12, in known manner, by means of a control lever 16 operated by means of an electromagnet, generally indicated 18. The latter has an outer casing 20 supported by the structure 10*a* of the motor 10, a winding 22, and a core 24 slidable axially along an axis X—X substantially parallel to the axis of rotation Y—Y of the shaft 12 of the starter motor 10. Within the casing 20 of the electromagnet 18, in correspondence with one end of the winding 22, there is a flange 25 with a central hole 25*a* in which a rod 26 is slidable, the rod having a first end 26*a* facing the core 24 of the electromagnet 18, and a second end 26*b* on which an annular shoulder 28 is formed. A substantially rectangular metal plate 30 is slidable on the rod 26, which is of electrically insulating material, in correspondence with a central hole 30*a* in the plate and is kept in abutment with the annular shoulder 28 by means of a helical spring 32 for taking up play. A second helical spring 34 is interposed between the annular shoulder 28 of the rod 26 and a cup-shaped element 36 mounted on the end of the hollow casing 20 with the interposition of a damping ring 38 of elastomeric material.

The cup-shaped element 36 is fixed to the flange 25 (which in turn is fixed to the hollow casing 20) by a pair of fixing screws 40 and carries a pair of fixed electrical contacts 42 each having a contact end 42*a* facing the metal plate 30 and a threaded end 42*b* for electrical connection outside the cup-shaped element 36.

The metal plate 30 which constitutes the movable contact is preferably made of copper and, in its face A opposite that which makes contact with the ends 42*a* of the fixed electrical contacts 42, has a straight V-shaped notch 44 arranged substantially on its centerline so as to be substantially equidistant from the fixed electrical contacts 42.

Figure 6:
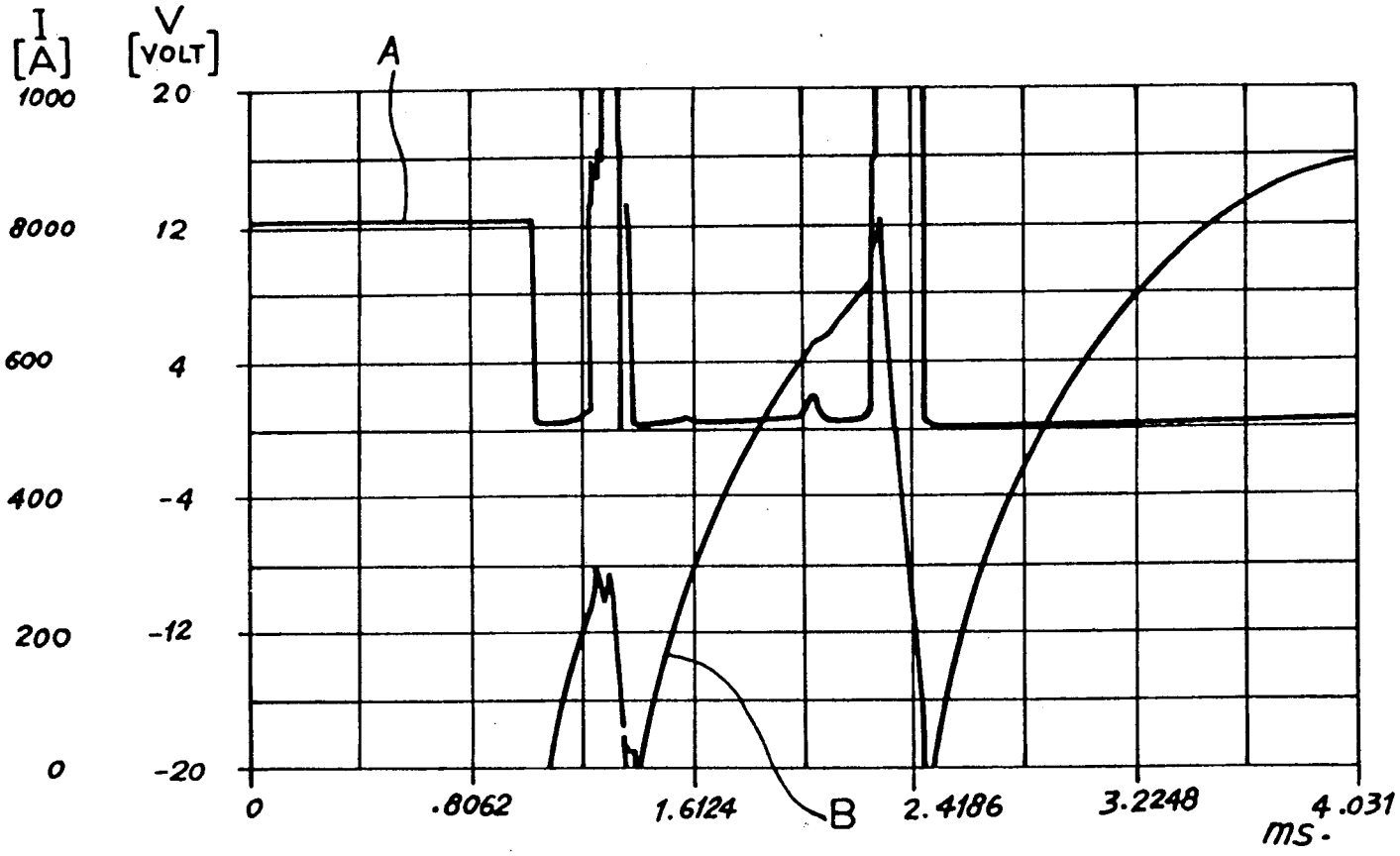
FIG. 6 PRIOR ART
FIG. 6 is a graph showing the variations of the voltage between the fixed contacts and of the intensity of the current supplied to the starter motor in a prior-art starter device.

During starting, after the pinion 14 has been engaged, the core 24 makes contact with the rod 26 during the last part of its travel, and the latter brings the plate 30 into contact with the ends 42*a* of the fixed electrical contacts 42 against the action of the spring 34. The presence of the spring 32 enables a further translation of the rod 26 and the spring 32 keeps the contact closed until starting is complete. FIG. 6 shows the variation with time of the voltage between the fixed electrical contacts of a prior-art starter device (line A), as well as the variation of the intensity of the current supplied to the starter motor (line B). High voltage peaks and interruptions of the electrical supply to the starter motor due to the "bouncing" of the movable electrical contact on the fixed electrical contacts can clearly be seen.

Figure 7:
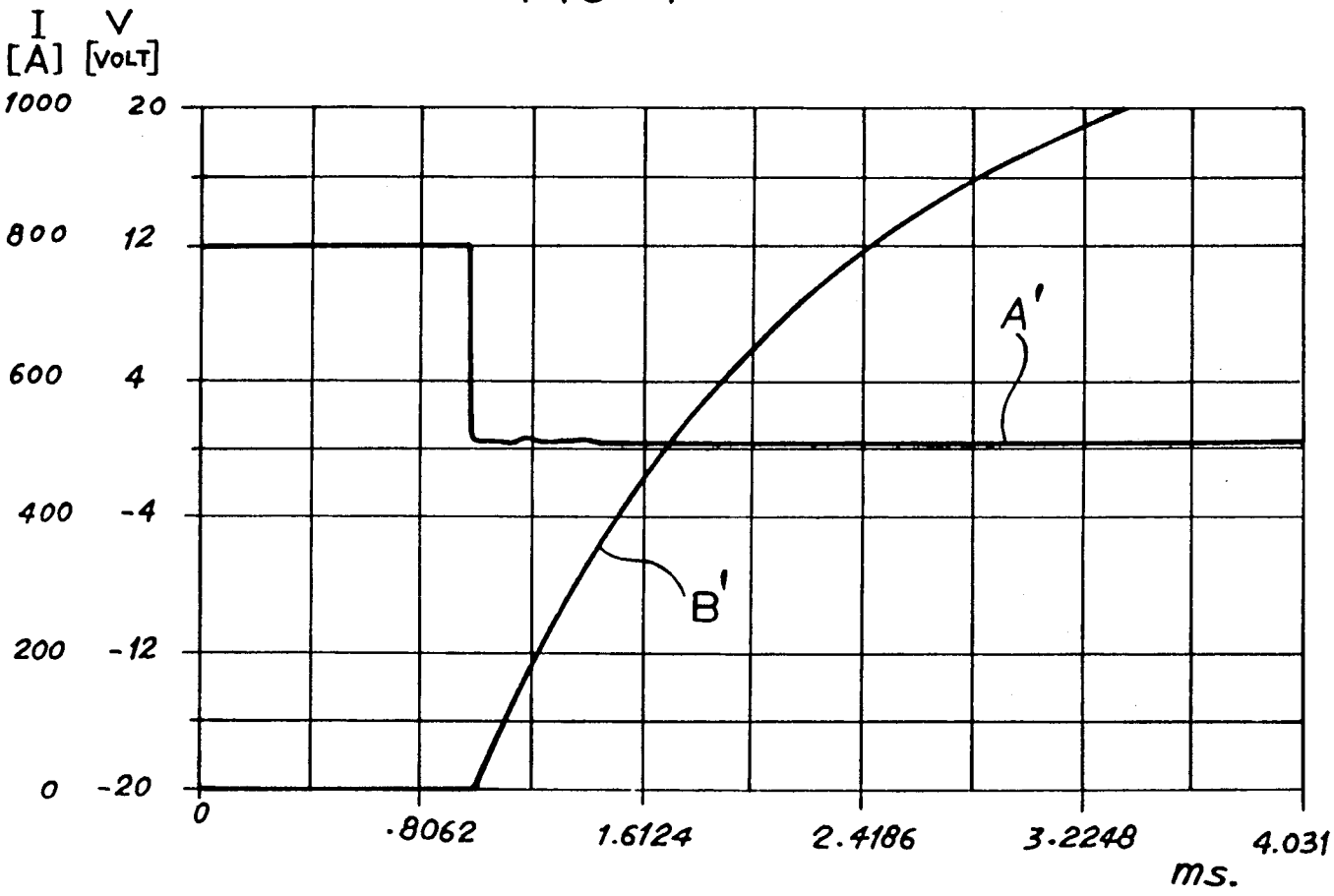
FIG. 7 is a graph similar to that of FIG. 6 but relating to a device according to the invention.

FIG. 7 shows the variations of the equivalent voltage (A') and current (B') in a starter device according to the invention. Neither voltage peaks nor interruptions of the electrical supply can be seen.

The absence of electrical arcs between the contacts when the circuit is closed has enabled the thickness of the movable contact 30 to be reduced considerably in comparison with known contacts. The optimum thickness has been found to be about 1.5 mm whilst, if the plate 30 is made of copper, the depth of the notch 44 may be between 0.1 and 0.57 mm. As well as affording an economic advantage, the reduction in the mass of the movable copper contact has reduced the impact stresses between the fixed and movable contacts. The results of endurance tests on the device according to the invention show that the problem of accidental welding of the contacts is completely eliminated and, furthermore, the wear of the movable contact 30 is practically negligible.

Moreover, the presence of the damping ring 38 which prevents a rigid contact between the casing 20 and the cup-shaped element 36 has further reduced the acceleration stresses on the fixed contacts 42. Naturally, it is intended that, the principle of the invention remaining the same, the details of construction and forms of embodiment may be varied widely with respect to those described and illustrated in the drawings, without thereby departing from the scope of the present invention.

What is claimed is:

1. A starter device for internal combustion engines, including a hollow support structure, fixed contacts carried by the structure, a movable element slidable in the hollow support structure and carrying a movable electrical contact for cooperating with the fixed contacts, during starting, wherein the movable electrical contact (30) is comprised of a plastically-deformable metal plate having a notch in one face of the plate between said fixed contacts for damping the impact between the movable contact (30) and the fixed contacts (42).

2. A starter device according to claim 1, wherein the plate (30) is substantially quadrangular and is mounted frontally on the end of a central rod (26) of the movable element, the notch being on the centerline of the plate (30) in a face (A) opposite that which makes the contact.

3. A starter device according to claim 1 wherein a cup-shaped element (36) is mounted on the hollow support structure (18) and carries the fixed contacts (42), a damping element (38) of elastomeric material being interposed between the structure (18, 24) and the cup-shaped element (36).

4. An electromagnetically-operated starter motor including an electromagnet for operating an engagement lever and also having a movable electrical contact for cooperating with fixed electrical contacts for supplying electricity to the motor after engagement, wherein the movable electrical contact comprises a plastically deformable metal plate (30) facing the fixed contacts (42) and having a straight V-shaped notch (44) in one of its faces (A), in a substantially central position relative to the fixed contacts (42*a*).

5. A starter motor according to claim 4, wherein the operating electromagnet (22, 24) is housed in a hollow casing (18) parallel to the housing of the starter motor (10) and has a cup-shaped element (36) of electrically-insulating material carrying the fixed contacts (42), a vibration-damping ring (38) of elastomeric material being interposed between the cup-shaped element (36) and the hollow casing (18).

* * * * *